United States Patent [19]

Lubniewski

[11] Patent Number: 4,844,462

[45] Date of Patent: Jul. 4, 1989

[54] ELECTRONIC RACING GAME APPARATUS AND METHODS

[76] Inventor: Michael Lubniewski, 19 E. Church St., Milltown, N.J. 08850

[21] Appl. No.: 219,762

[22] Filed: Jul. 15, 1988

[51] Int. Cl.[4] ..... A63F 9/00

[52] U.S. Cl. ..... 273/86 B; 273/237

[58] Field of Search ..... 273/1 E, 85 G, 86 B, 273/138 A, 237, 238

[56] References Cited

U.S. PATENT DOCUMENTS

| | | | |
|---|---|---|---|
| 3,417,995 | 12/1968 | Creely | 273/1 E |
| 3,563,552 | 2/1971 | Korff | 273/1 E |
| 4,093,223 | 6/1978 | Wilke et al. | 273/85 G |

*Primary Examiner*—Maryann Lastova
*Attorney, Agent, or Firm*—Arthur L. Plevy

[57] ABSTRACT

An electronic racing game apparatus employs a microprocessor which controls a plurality of incandescent lamps. The lamps are arranged in an XY matrix as each lamp is indicative of a lane and a position about an oval track display. When power is first initiated, the microprocessor is reset and then displays a spiral pattern which serves to attract participants to the game site. The pattern spirals until a start button is accessed, whereby the finish order displays are cleared and the contestant lamps of each lane or contestant sequentially come to the starting line. After a short delay the bell rings and the race begins. The contestants as indicated by the lamps race around the oval display in a random pattern, as determined by a random number table. The lamps associated with each oval are illuminated according to the table. As the first, second and third contestants cross the finish line, the numbers of their lane will appear on the win, place and show displays. All the racers continue across the finish line and proceed about a 1/4 lap past the finish. The win, place and show displays permanently illuminate and the spiral display pattern resumes until the next race is started by implementing the start button.

20 Claims, 15 Drawing Sheets

RANDOM NUMBER LIST (400 WORDS)

FIG. 4

| | | | | | | | | | |
|---|---|---|---|---|---|---|---|---|---|
| 1 | 2 | 3 | 4 | 5 | 6 | 7 | 8 | 9 | 10 |
| 1 | 2 | 3 | 4 | 5 | 6 | 7 | 8 | 9 | 10 |
| 7 | 8 | 9 | 10 | 1 | 2 | 3 | 4 | 5 | 6 |
| 10 | 1 | 2 | 3 | 4 | 5 | 6 | 7 | 8 | 9 |
| 10 | 1 | 2 | 3 | 4 | 5 | 6 | 7 | 8 | 9 |
| 5 | 6 | 7 | 8 | 9 | 10 | 1 | 2 | 3 | 4 |
| 5 | 6 | 7 | 8 | 9 | 10 | 1 | 2 | 3 | 4 |
| 10 | 1 | 2 | 3 | 4 | 5 | 6 | 7 | 8 | 9 |
| 8 | 9 | 10 | 1 | 2 | 3 | 4 | 5 | 6 | 7 |
| 8 | 9 | 10 | 1 | 2 | 3 | 4 | 5 | 6 | 7 |
| 8 | 9 | 10 | 1 | 2 | 3 | 4 | 5 | 6 | 7 |
| 6 | 7 | 8 | 9 | 10 | 1 | 2 | 3 | 4 | 5 |
| 4 | 5 | 6 | 7 | 8 | 9 | 10 | 1 | 2 | 3 |
| 4 | 5 | 6 | 7 | 8 | 9 | 10 | 1 | 2 | 3 |
| 1 | 2 | 3 | 4 | 5 | 6 | 7 | 8 | 9 | 10 |
| 9 | 10 | 1 | 2 | 3 | 4 | 5 | 6 | 7 | 8 |
| 4 | 5 | 6 | 7 | 8 | 9 | 10 | 1 | 2 | 3 |
| 3 | 4 | 5 | 6 | 7 | 8 | 9 | 10 | 1 | 2 |
| 3 | 4 | 5 | 6 | 7 | 8 | 9 | 10 | 1 | 2 |
| 3 | 4 | 5 | 6 | 7 | 8 | 9 | 10 | 1 | 2 |
| 3 | 4 | 5 | 6 | 7 | 8 | 9 | 10 | 1 | 2 |
| 4 | 5 | 6 | 7 | 8 | 9 | 10 | 1 | 2 | 3 |
| 5 | 6 | 7 | 8 | 9 | 10 | 1 | 2 | 3 | 4 |
| 6 | 7 | 8 | 9 | 10 | 1 | 2 | 3 | 4 | 5 |
| 6 | 7 | 8 | 9 | 10 | 1 | 2 | 3 | 4 | 5 |
| 1 | 2 | 3 | 4 | 5 | 6 | 7 | 8 | 9 | 10 |
| 1 | 2 | 3 | 4 | 5 | 6 | 7 | 8 | 9 | 10 |
| 8 | 9 | 10 | 1 | 2 | 3 | 4 | 5 | 6 | 7 |
| 7 | 8 | 9 | 10 | 1 | 2 | 3 | 4 | 5 | 6 |
| 7 | 8 | 9 | 10 | 1 | 2 | 3 | 4 | 5 | 6 |
| 3 | 4 | 5 | 6 | 7 | 8 | 9 | 10 | 1 | 2 |
| 3 | 4 | 5 | 6 | 7 | 8 | 9 | 10 | 1 | 2 |
| 3 | 4 | 5 | 6 | 7 | 8 | 9 | 10 | 1 | 2 |
| 7 | 8 | 9 | 10 | 1 | 2 | 3 | 4 | 5 | 6 |
| 7 | 8 | 9 | 10 | 1 | 2 | 3 | 4 | 5 | 6 |
| 7 | 8 | 9 | 10 | 1 | 2 | 3 | 4 | 5 | 6 |
| 10 | 1 | 2 | 3 | 4 | 5 | 6 | 7 | 8 | 9 |
| 10 | 1 | 2 | 3 | 4 | 5 | 6 | 7 | 8 | 9 |
| 10 | 1 | 2 | 3 | 4 | 5 | 6 | 7 | 8 | 9 |
| 10 | 1 | 2 | 3 | 4 | 5 | 6 | 7 | 8 | 9 |

LOAD SPIRAL ROUTINE

ENTRY: NONE

EXIT: SPIRAL PATTERN IS LOADED INTO POSITION LIST

DISPLAY MUX ROUTINE

ENTRY: DATA TO BE DISPLAYED IS PUT IN LANE AND POS TABLES

EXIT: DATA HAS BEEN OUTPUT (MUXED) ONCE

BRING TO START ROUTINE

ENTRY: SPIRAL PATTERN IS BEING INCREMENTED AND DISPLAYED

EXIT: LANES ARE SEQUENTIALLY BROUGHT TO STARTING LINE (CLEARED)

BELL RING ROUTINE

ENTRY: CONTESTANTS HAVE BEEN BROUGHT TO START

EXIT: BELL RINGS FOR A DELAY AS CONTESTANTS LEAVE STARTING LINE

NOTE: USES 8TH BIT OF LANE OUTPUT AS OUTPUT FOR BELL

ENTRY: A RANDOM CONTESTANT HAS BEEN INCREMENTED ONCE

EXIT: THIS TIME DELAY IS EXECUTED BEFORE NEXT CONTESTANT CAN BE INCREMENTED

ENTRY: CONTESTANT TO BE INCREMENTED IS SET UP BY RANDOM INCREMENT ROUTINE

EXIT: CONTESTANT IS INCREMENTED, ALSO LATEST POSITION COUNT IS PUT IN (A)

ENTRY: # TO BE OUTPUTTED IS SET UP BY RUN INTERRUPT ROUTINE

EXIT: (A) CONTAINS BIT PATTERN TO BE OUTPUTTED TO DISPLAYS

ELECTRONIC RACING GAME APPARATUS AND METHODS

BACKGROUND OF THE INVENTION

This invention relates to an electronic racing game in general and more particularly to an electronic racing game which is controlled by a microprocessor which enables random operation of the game apparatus.

Generally, the prior art is aware of numerous types of racing and other various games of chance which all rely on the unpredictability of the results. Such games are utilized to occupy participants to enable wagering or otherwise predict the results of the particular game. As one can ascertain, such games are generally operated according to random techniques whereby the winner of the game as selected is random in nature. Thus each game contestant has a relatively equal chance of winning.

As indicated above, the prior art is aware of such techniques.

See for example, U.S. Pat. Ser. No. 3,587,100 issued on June 22, 1977 to W. Doremus, et al. entitled SIGNAL TRANSMISSION AND RECEIVING SYSTEM. This patent shows a signal transmission system whereby racing vehicles or other vehicles carry transmitters and signals are received and displayed on an oval display consisting of a plurality of lights.

U.S. Pat Ser. No. 3,645,531 issued on Feb. 29, 1972 to L. Wright and entitled RANDOMLY OPERATED PICTURE PROJECTING CHANCE APPARATUS. This patent shows a game device whereby motion picture film such as an endless film of horse racing is arbitrarily and randomly displayed. Based on the arbitrary nature, a different horse race will be pictured with different winners in a random manner.

U.S. Pat. Ser. No. 3,729,193 issued on April 24, 1973 to G. H. Labis and entitled ELECTRONIC RACING GAME shows a system for racing a plurality of motor driven units which may also consist of a light presentation. The system uses two pulse sources which are operated at different frequencies to produce a random display. This system is capable of displaying win, place and show as well as a particular payment for each of the electronic contestants depicted in the display.

U.S. Pat. Ser. No. 4,373,723 issued on Feb. 15, 1983 to G. E. R. Brown entitled AMUSEMENT APPARATUS shows a racing system which incorporates a random procedure based on stored information and can formulate odds according to the displays.

U.S. Pat. Ser. No. 4,527,798 issued on July 9, 1985 to W. R. Sickierski entitled RANDOM NUMBER GENERATING TECHNIQUE AND GAMING EQUIPMENT EMPLOYING SUCH TECHNOLOGIES includes a random number generator and a gaming machine including a memory to control a race which is visually displayed on a computer display. The random number generator includes a variable counter where the output of the counter after full count is then subjected to another random number algorithm to obtain complete randomness of the display. The memory uses stored probability tapes which display odds associated with the probability of occurrence of the several events set forth.

As one can see from the above and other patents, there are many structures in the prior art which pertain in general to such random racing apparatus. As one can ascertain from the above patents, the devices are relatively complicated and difficult to construct. Furthermore, the devices are extremely expensive. As one can ascertain, it is a requirement for such devices that they serve to amuse the users of such devices while presenting a reasonable display to enable a user to participate according to the random nature of the display. Such devices may be employed for example at amusement parks, carnivals and other areas where games of chance are employed in general.

It is therefore an object of the present invention to provide a simplified random racing apparatus which also utilizes unique display characteristics which operate to attract participants to the apparatus and to enable such participants to operate the apparatus which after the start of the race operates in a completely random manner.

BRIEF DESCRIPTION OF THE PREFERRED EMBODIMENT

An electronic game apparatus comprising a plurality of visual display indicators arranged in an oval pattern indicative of a race track display, with said pattern formed by said display indicators having a plurality of concentric ovals each indicative of a racing position, with each concentric oval having the same number of display indicators about said oval as said other ovals with each indicator in an oval indicative of a position about said oval, with each of said indicators arranged in an X-Y pattern to be accessed by a separate X-Y address, where X is the one address of said oval and Y is the address of said position indicators, microprocessor means coupled to said X-Y matrix for randomly selecting said X-Y addresses according to a stored table in memory to cause said indicators to illuminate in a random pattern about said oval during a racing mode, activatable means coupled to said microprocessor means for selecting said racing mode to cause said microprocessor means to implement said random selection during said racing mode, said microprocessor including means for storing the results of each race indicative of one of said racing positions completing said race track display as randomly implemented to display said completed position indicative of a winner and means for illuminating said display with a repetitive offset pattern during a non-racing mode to cause said indicators to provide a display pattern which has visual appeal.

BRIEF DESCRIPTION OF THE FIGURES

FIG. 4 shows a random number list according to this invention.

DETAILED DESCRIPTION OF THE FIGURES

Figure 1:
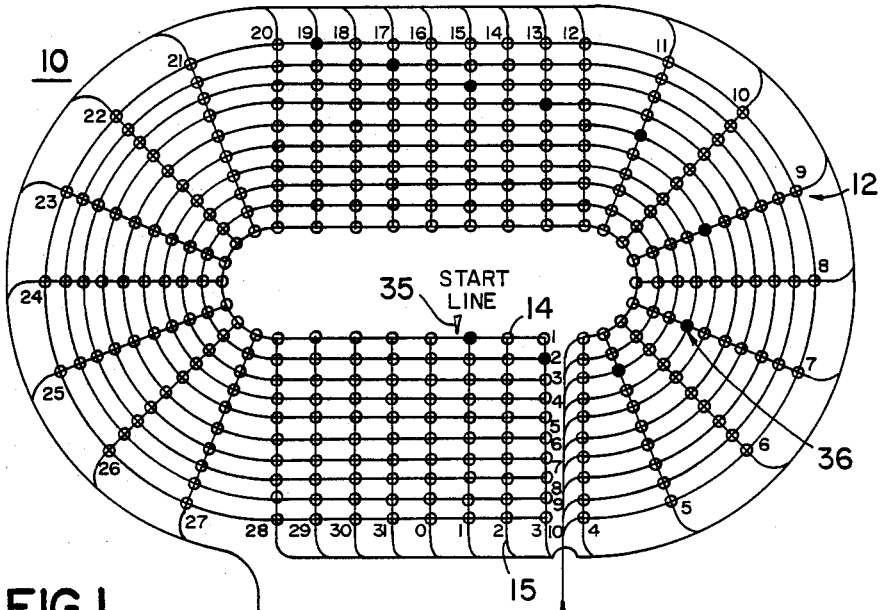
FIG. 1 is a simple block diagram depicting a electronic racing apparatus according to this invention.

Referring to FIG. 1, there is shown an oval track configuration 10. As will be explained, the oval track configuration is controlled by a microprocessor 11. The microprocessor 11 is a conventional microprocessor such as Motorola Type 6802. It will be understood during the explanation of this invention that other types of microprocessors can be employed as well as actual logic modules can be employed in lieu of a microprocessor. As one will ascertain, the apparatus is capable of being implemented by prewired integrated circuit modules such as digital modules which are commonly available.

As one can see, the track arrangement is arranged in an oval shape and contains a plurality of incandescent lamps such as 12. The incandescent lamps are arranged in concentric oval formats with each concentric oval indicative of a post position or a lane position where each oval represents a number of a game contestant. As one can further determine from FIG. 1, the arrangement consists of 10 separate lanes or 10 separate concentric ovals which extend about the display from top to bottom and for example designated as reference numeral 14 for a first lane and reference numeral 15 for the last lane. Each lane or oval contains 32 position lamps which are arranged about the oval. In this manner, there are 320 lamps which constitute the entire display. Each lamp, as will be further described, is an incandescent lamp such as the 12 volt type and therefore illuminates quite brightly. The entire configuration depicted as an oval track is essentially a matrix arrangement whereby each lamp in the arrangement is determined by a position number and a lane number. The microprocessor 11 as indicated and as will be explained has a plurality of outputs in which a first plurality indicative of the positions (as indicated above as 32 positions) are outputted to a register 20. The outputs of the register controls in 32 position drivers 21 which access each of the positions as zero to 31 and therefore provides an indication of the position number associated with the oval. The position drivers are power transistor circuits which are operated to illuminate the associated lamps. In a similar manner a output register 22 receives lane outputs from the microprocessor 11 and essentially is coupled or applied to a lane driver module 23 which has 10 outputs indicative of the lanes 1–10 associated with the oval track display 10.

As will be further explained, the microprocessor 11 has an internal memory which memory is partitioned so that a first memory portion 25 has stored therein a random number table. This table as will be explained is indicative of each of a number of random positions that each contestant in each lane can assume. The apparatus as will be further described, has a portion of memory 26 which is reserved for a spiral display mode. As will be explained, during a non-racing mode, the lamps which comprise the oval track display are caused to be controlled or illuminated according to a spiral pattern. This pattern appears to continuously rotate creating a very aesthetic and pleasing pattern which is attractive to persons in the vicinity of the display. In this manner the spiral pattern which is extremely aesthetic and interesting operates to attract participants to engage in the racing procedure associated with the game as will be further explained.

Figure 2:
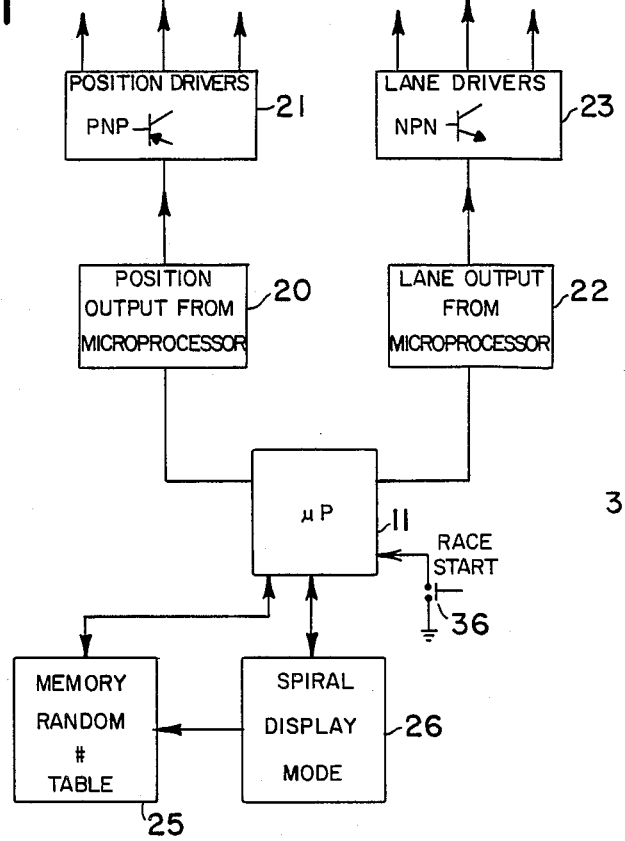
FIG. 2 is a circuit diagram depicting the operation of the plurality of indicator lamps associated with the display of FIG. 1.
Figure 2:
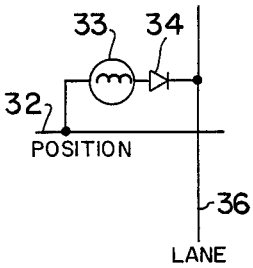

Referring to FIG. 2, there is shown a simple schematic on how each incandescent lamp associated with the oval display 10 is illuminated. As indicated, the lamps are arranged in a matrix display wherein one wire of the matrix designated as 30 is indicative of a lane position while the second wire 32 is indicative of the position about the track. Hence, when a positive voltage is applied to terminal 32 and a ground applied to terminal 30, the incandescent lamp 33 will illuminate due to the presence of the diode 34 which is biased in the forward direction. The diode 34 prevents back illumination of the lamp 33 for biasing voltages applied to other grid points which are not to be illuminated during operation.

The provision of an XY grid arrangement where X is indicative of the position drivers--namely, 32 outputs or 32 X lines, while Y would be indicative of the lane position as 10 Y lines is well known. The matrix is therefore a 32 by 10 X-Y matrix to thereby define 320 unique addresses each associated with a corresponding lamp. As will be explained, the system operates to randomly control the illumination of the various lamps of the oval display. As seen in FIG. 1, there is a start line designated by reference numeral 35. This start line, as will be explained, is where the race begins as soon as all contestants involved are positioned at the start position. The start position is designated by the reference numeral zero (indicative of the position 0), and during the start of the race, all lamps arranged in Column 0 are illuminated. Also as seen in FIG. 1, certain indicator lamps are designated and represented by a black or a filled in circle as for example circle 36 associated with the lamp in position 7 and lane 4. The darkened circles represent the initial position of the spiral pattern which is generated during a non-racing display. As one can see and commencing from position 1, the top lamp indicative of lane 1 is first illuminated during the spiral pattern. The next lamp in position 3 of lane 2 is illuminated. The next lamp in position 5 and lane 3 is illuminated. The next lamp in position 7 and lane 4 is illuminated. The next lamp in position 9 and lane 5 is illuminated so on. Hence, as one can see, this is a definite sequence. During the spiral mode, each lamp is sequentially moved to the next position and continues to move so that the generation of the complete spiral pattern is obtained. The repetition rate of the pattern is controlled by a suitable clock associated with the microprocessor but the repetition rate is such that a user can visually perceive the spiral pattern during a non-race mode. In this manner, the spiral serves as an attractive visual display to attract participants to participate in the racing procedure.

Before a detailed explanation of how the system operates, it would be helpful to indicate the general nature of system operation. When the game is first turned on, the microprocessor 11 is reset and this initiates the spiral pattern display. The spiral pattern appears on the track display and will appear to rotate around the track as indicated in a eye catching pattern. This pattern continues until the start button 36 is pushed. Pushing or activating the start button, the win, place and show displays (FIG. 3) will be cleared and the lane lamps are sequentially advanced to the starting line 35. After all lamps indicative of the racers are at the starting line, there will be a short delay, then a bell will ring to start the race. The racers, as indicated by the lamps, will continue around the track in a random race pattern. The duration of the race, as will be explained, can be one or more laps about the track. As the first, second and third racers cross the finish line, their number will appear on the win, place and show displays. All the racers will continue across the finish line and then proceed about ¼ lap past the finish line. At the end of the race, the display then changes back to the spiral display pattern leaving the results of the race on the win, place and show displays until the next race is started. With the above description in mind and referring to FIG. 3, there is shown an overlay which is a Plexiglass or other transparent display having impressed thereon various indicia to indicate to the participants the exact format of the game. As seen, the Plexiglass display has a frame 41 which essentially has a central oval which oval has the win, place and show windows, 42, 43 and 44 and also has the start line 35 indicative of the 10 lanes, one–ten, or 10 racers.

Figure 3:
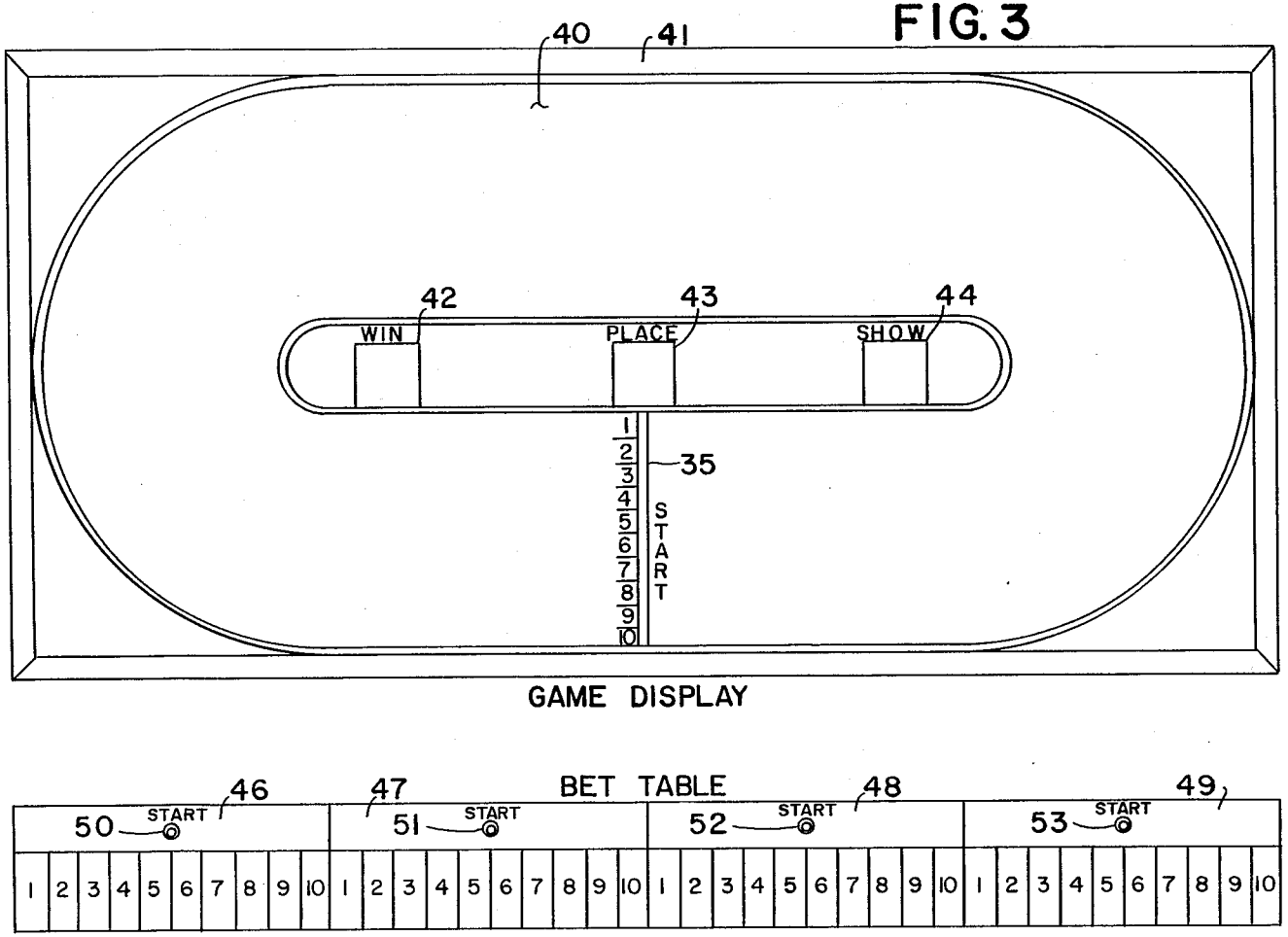
FIG. 3 shows an overlay for the display of FIG. 1 including a betting table suitable for interfacing with game participants.

As seen from FIGS. 1 and 3, the plexiglass frame is placed over the display oval 10 of FIG. 1, the start line 35 will be indicative of the 10 racer positions. The win, place and show windows are each associated with a two-digit seven segment digital display such as an LCD, LED or other type of display whereby the number of the winning participant will be illuminated in window 42, the number of the participant who places second will be illuminated in window 43 and the number of the participant who places third will be illuminated in the show window 44.

It is, of course, understood and relatively conventional to illuminate or to provide a seven segment or other display indicative of numbers as for example 1–10. Also shown in FIG. 3 is a bet table. The bet table consists of various positions each associated with a start button as 50, 51, 52 and 53. Each bet table includes individual sections as 46, 47, 48, and 49. As one can ascertain, a number of participants which may be for example 10 different individuals are placed in front of the particular bet tables 46, 47, 48 and 49. The participant makes his selection in regard to the lane number as for example 1–10 and indicates which lane he is betting on as to win, place or show. After this occurs, then each participant will access the start button in an attempt to start the race. As soon as the computer or microprocessor receives the acknowledgement of the start as shown in FIG. 1, for example as start race button 36, the microprocessor will access the program and operate the race according to the above description. In this manner the lamps will be illuminated according to the lane position as formulated by a random number table to control the race. The progress of each of the lanes is indicated by the various bulbs spread about the oval in the indicated positions. Namely, each lane will traverse 32 positions in order to finish a race. When the race is terminated by the bulbs again appearing at the start line, the first second and third positions as indicated above will appear in the win, place and show windows 42, 43, and 44. This will therefore indicate to each contestant how he fared. It is understood that when the contestant presses the required buttons associated with his position table as for example table section 46, these may be entered in the computer in an ordinary manner so that the computer can correlate the selections made by each of the persons positioned at tables 46 to 49. It is understood that FIG. 3 shows four such tables and more or less table areas could actually be implemented for each race as 5, 6 or 7. It is, of course, understood that there can be a plurality of tables which far exceed the number of lanes as this is a pure function of the desire of the operator of the game who may provide tables for as many contestants as desired.

It is noted that each of the betting table positions enables each participant to select a first, a place and a show lane by depressing the ten buttons associated with each bet table. It is understood that the selections made by each contestant can be monitored by the computer or microprocessor utilizing conventional techniques or may simply be indicated by a series of illuminations or by different pegs where the user will insert a win peg, a place peg and a show peg in each of the allocated spaces indicating his selected positions. The purpose of the bet table format is to enable participants to engage in the racing game as desired.

Referring to FIG. 4, there is shown a random number list which consists of 400 words. As one can ascertain by reviewing a list of FIG. 4, each of the contestants indicative of lanes one to ten is represented an equal number of times on the list. That is each contestant as 1–10 is represented by 40 positions in the list. The list has been formulated so that it contains 400 words with each contestant having 40 places on the list arranged in a pseudo-random order so that when the order is read off it produces a pattern similar to 10 racers moving ahead and/or falling behind as they race toward the finish line. The list as will be explained is constantly rotated while the game is in the non-racing mode whereby the game will display the above-noted spiral display pattern. The random nature of the game is enhanced in that when the game is in the non-racing mode, it is impossible to know where the list is at or where the processor will start drawing numbers from. Because each of the 10 contestants has 40 places on the list, each have exactly the same chance of winning. Their luck or chances of winning is determined by where the list is at when the race is started. The list is large enough so as to minimize repetitive patterns from developing. As one can ascertain from FIG. 4, the list as indicated consists of 400 words and essentially is stored in the microprocessor memory 25 as shown in FIG. 1.

The microprocessor is controlled to operate according to the above description by 12 separate programs. The 12 programs will be described in conjunction with the following figures. The order of the programs are as follows.

Figure 5:
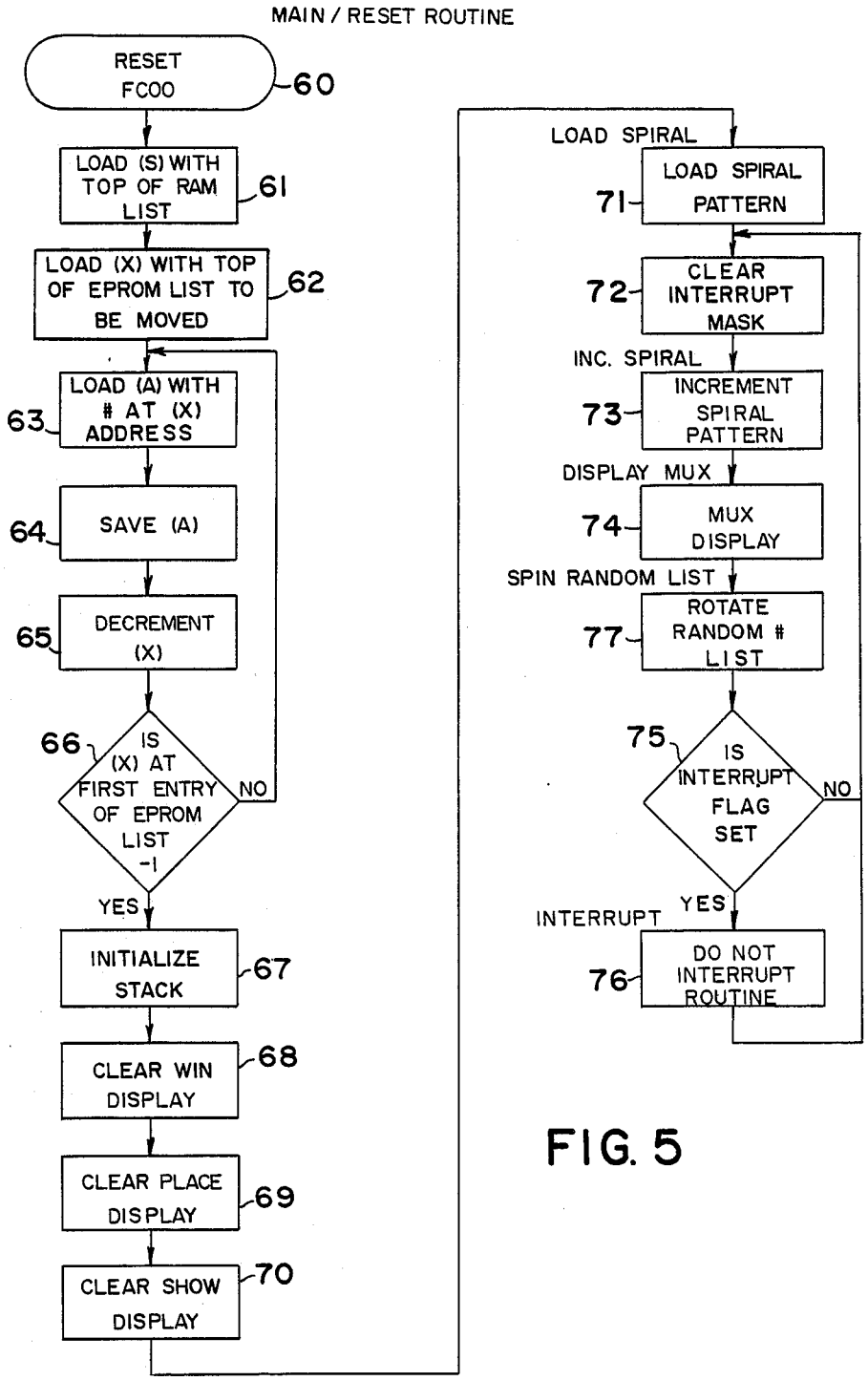
FIG. 5 is a flow chart depicting a main reset routine for a microprocessor controlled game apparatus according to this invention.

1. Main/Reset Routine
2. Load Spiral Routine
3. Increment Spiral Routine
4. Display MUX Routine
5. Spin Random Routine
6. Run Interrupt Routine
7. Bring To Start Routine 8. Bell Ring Routine
9. Bell On Delay Routine
10. Increment Delay Routine
11. Random Increment Routine
12. Ram Increment/Ram Decode Routine As seen in FIG. 5, there is shown the Main/Reset Routine which is implemented by conventional program techniques with the above-described microprocessor or the microprocessor shown in FIG. 11. As indicated above, when power is turned on, the processor is reset and the spiral display will appear on the track format and will appear to rotate around the track in an eye catching pattern. As seen from FIG. 5, the steps labeled 60–66 show the Initialization Routine whereby the various programs are set into the microprocessor after reset to enable the microprocessor to continue with the various programs as will be discussed. The steps indicated as 60–66 are the basic initialization steps to load from the microprocessor RAM and EPROM the various lists which are to be processed as well as the various instructions to be implemented by the program. As can be seen from module 66, after the reset conditions are properly implemented, the stack is initialized 67, the win display is cleared 68, the place display is cleared 69 and the show display is cleared 70, thus the various displays as shown in FIG. 3 are all cleared. The next operation that occurs is indicated by module 71 where the Load Spiral Pattern Display is loaded into the computer memory. The computer then continues to operate on the spiral pattern as indicated by module 73 where the computer implements the spiral pattern to cause the spiral pattern to traverse the oval track by means of the display lamps.

The module 74 indicates the MUX or multiplexer display which is a separate program to illuminate the display. As indicated previously during the operation of the spiral pattern display, the system continues to rotate the random number list as shown in FIG. 4. This is indicated by spin random list routine and is indicated in module 77. In the meantime, the system as indicated in module 75 is looking for an interrupt which is indicative of the start of a race. If there is no interrupt, the system continues to operate in the spiral pattern mode. If there is an interrupt as indicated by module 76, the system goes to the Run Interrupt Routine (FIG. 10) whereby the main program regarding the actual race conditions will be implemented.

Figure 6:
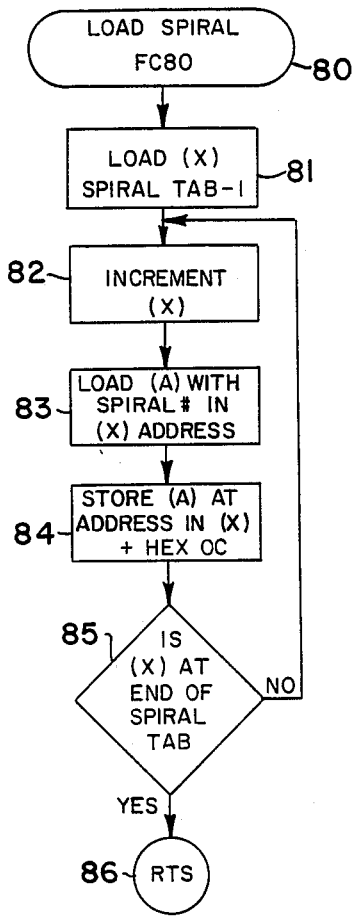
FIG. 6 shows a Load Spiral Routine associated with the game apparatus.

FIG. 6 shows the Load Spiral Routine. The Load Spiral Routine has been indicated in FIG. 5 by module 71. FIG. 6 by modules 80–86 shows this routine whereby the spiral pattern is loaded into the computer registers as indicated by module 81 and is incremented as indicated by module 82. As indicated and shown in FIG. 1, the spiral pattern routine indicates the following lamp to be illuminated. The spiral list essentially causes the following initial lanes to be implemented as shown in FIG. 1—namely, 1, 3, 5, 7, 9, 11, 13, 15, 17, and 19. This list is incremented by one or two positions to cause the spiral to appear to traverse the track display. The program for loading the spiral is shown in FIG. 6 via modules 80–86. Thus, basically as seen in FIG. 6, the spiral pattern is loaded into the position list.

Figure 7:
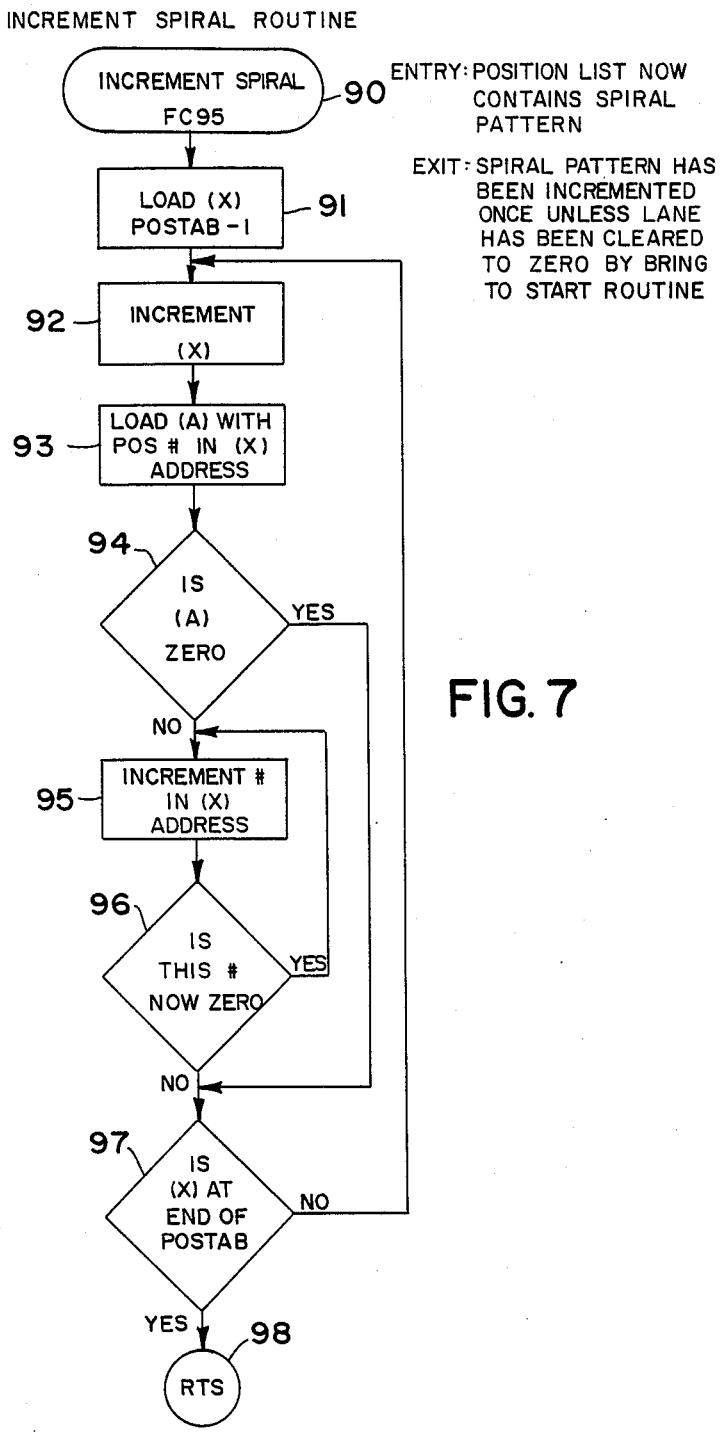
FIG. 7 shows an Increment Spiral Routine in flow chart form according to this invention.

Referring to FIG. 7, there is shown the Increment Spiral Routine. The Increment Spiral Routine is shown by modules 90 to 98. Since the position list now contains the spiral pattern which is the function of FIG. 6, the spiral pattern will be incremented once unless the lane has been cleared to zero by activation of the start switch thereby bringing or implementing the Start Routine.

Figure 8:
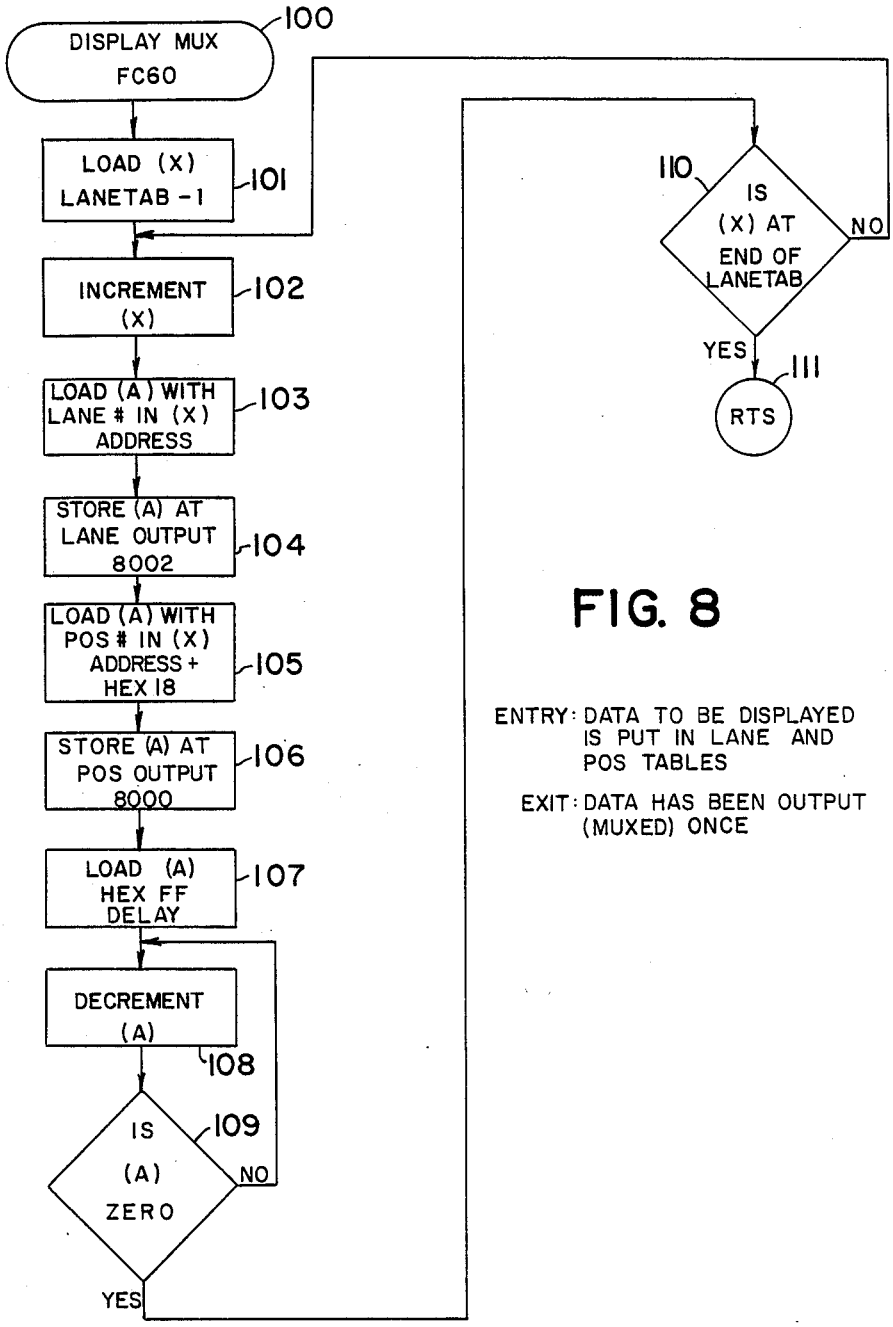
FIG. 8 shows a Display MUX Routine in flow chart form.

Referring to FIG. 8, there is shown the Display MUX Routine. As indicated in FIG. 8, the program consists of the functions performed by modules 100 to 111. The main function of this routine is to put data to be displayed in the lane and position tables. One exits the routine after the data has been output or MUXed once. This program activates the X-Y matrix to illuminate the lamp of the display according to selected X and Y positions.

Figure 9:
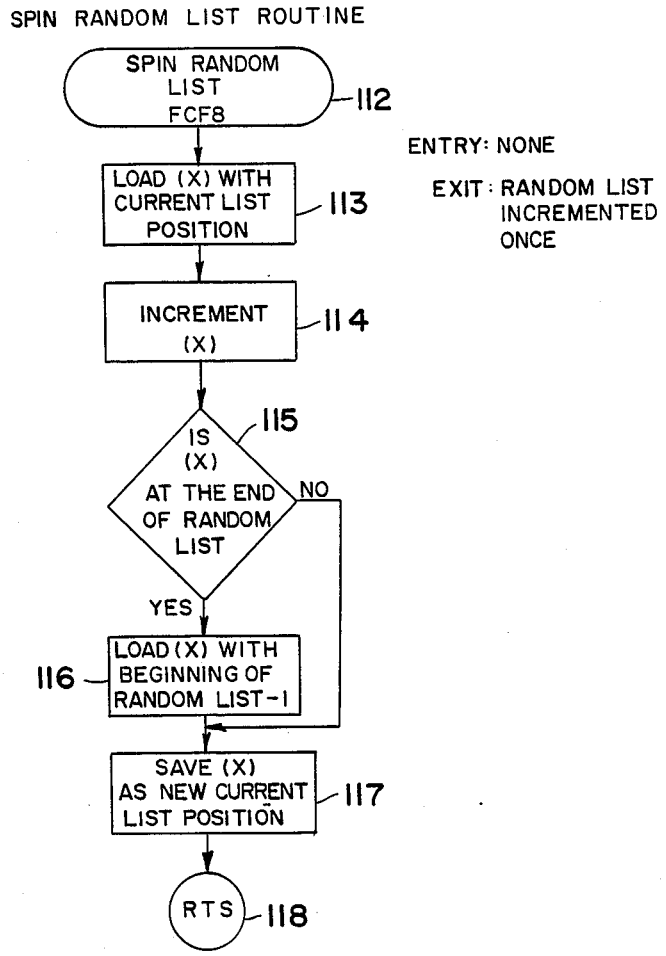
FIG. 9 shows a Spin Random List Routine in flow chart form.

FIG. 9 shows the Spin Random List Routine indicated by modules 112 to 118. As one can again ascertain and as shown in FIG. 5, the spin random list is implemented by module 77. Thus during the time when no race is commencing and the spiral pattern is being displayed, one moves the random list accordingly. Hence, when an interrupt is initiated by means of a start button, the random list then starts from a completely random position on the 400 word table. In this manner, as indicated above, one cannot know where the random list is accessed, and hence the depression of a start button associated with the betting table buttons as 50 to 53 occurs and the start of the race is initiated in a completely random manner which is done by the Spin Random List Routine shown i FIG. 9.

Figure 10:
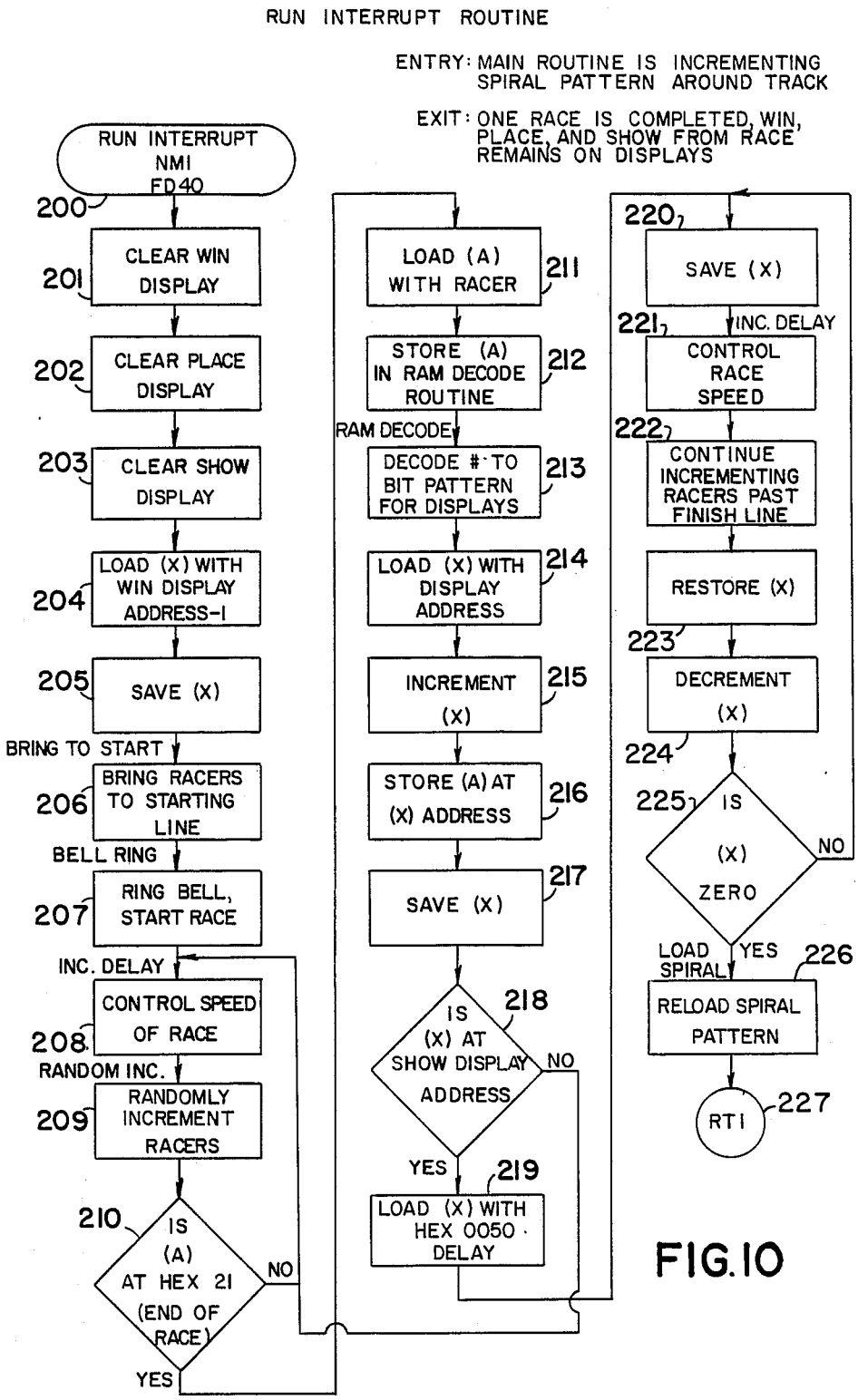
FIG. 10 shows a Run Interrupt Routine in flow chart form.

Referring to FIG. 10, there is shown the Run Interrupt Routine. The Run Interrupt Routine is commenced by the activation of the start button. The entry to this routine is that the main routine is incrementing the spiral pattern around the track which is for example shown in FIG. 5. The exit for the routine is that once the race is completed, the win, place and show displays are activated and these displays remain displayed whereby the spiral pattern is again continued. As seen from FIG. 10, when a run interrupt is received as shown in module 200, the first thing that the system does is to clear the win, place and show displays indicated by modules 201 to 203. The next routine that is run is the Bring to Start Routine as indicated by module 206 where each of the lanes which have been traversing the spiral pattern is brought sequentially to the start line whereby all the lamps in the start column are illuminated. Once all lanes are brought to the start column as indicated by module 206, the Bell Ring Routine is implemented as shown in module 207. As one will ascertain, once all the lanes or contestants are at the start lane, a bell is rung. This can be done by a separate output from the microcomputer which activates a suitable bell. The bell rings indicating the start of race. Module 208 indicates that the speed of the race is controlled. The speed of the race including a specific delay is controlled according to the program content a hence the speed of the illumination of the various light run by the random table of FIG. 4 is controlled to provide reasonable display mode. Module 209 indicates that the lanes or racers are incremented randomly according to the table of FIG. 4. Module 210 makes a determination as to whether or not there is an end of race. If there is no end of race then the operation continues. If there is an end of race, the various positions as first, second and third are loaded into the output display modules to eventually be displayed in a seven-segment display. This is indicated by modules 211 to 218. Thus, after the last racer or the show position has been indicated, the race continues where each of the racers pass the finish line and thereafter the spiral pattern as indicated by module 226 is loaded. Thus, at the end of the Run Interrupt Routine, the win, place and show windows indicated in FIG. 3 will display the contestants in that order and then the spiral pattern routine will continue operation.

Figure 11:
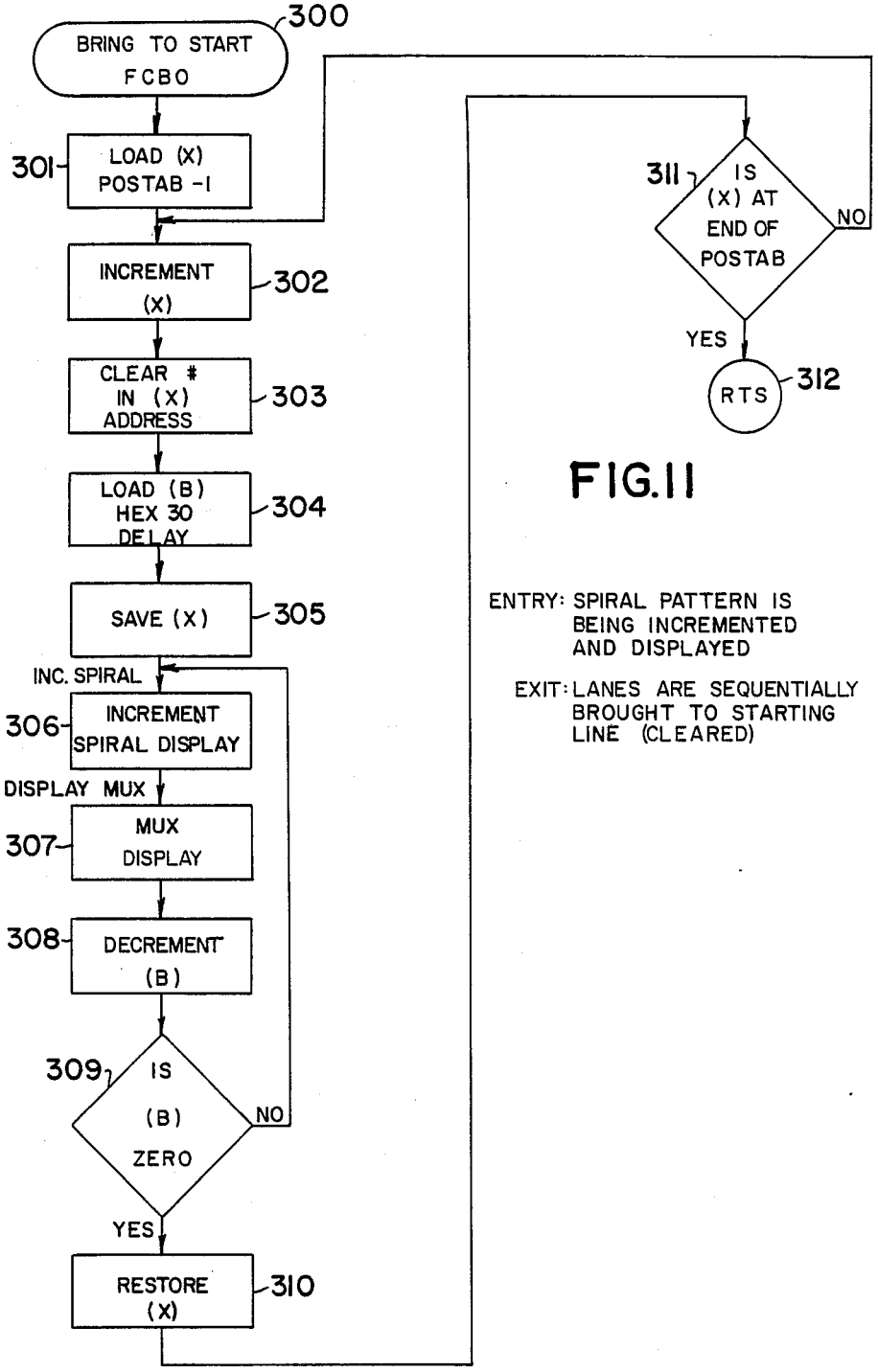
FIG. 11 shows a Bring To Start Routine in flow chart form.

Referring to FIG. 11, there is shown the Bring to Start Routine which has been indicated in FIG. 10 by module 206. As indicated above, once an interrupt button is depressed by any one of the participants who have access to the betting table, the microprocessor proceeds to sequentially bring each of the lane contestants as 1–10 to the starting line position before terminating the spiral pattern display. The program shown in FIG. 1 accomplishes this. The entry to the program is that the spiral pattern is being incremented and displayed and the exit is that the lanes are sequentially brought to the starting lane or cleared. The program indicates that this is done by utilizing the incrementing spiral and display MUX routine. Thus, each of the lamps as shown in FIG. 1 by the darkened circles is brought to the start line and stopped whereby at the start of the race the various lanes are aligned in the vertical position to commence race start.

Figure 12:
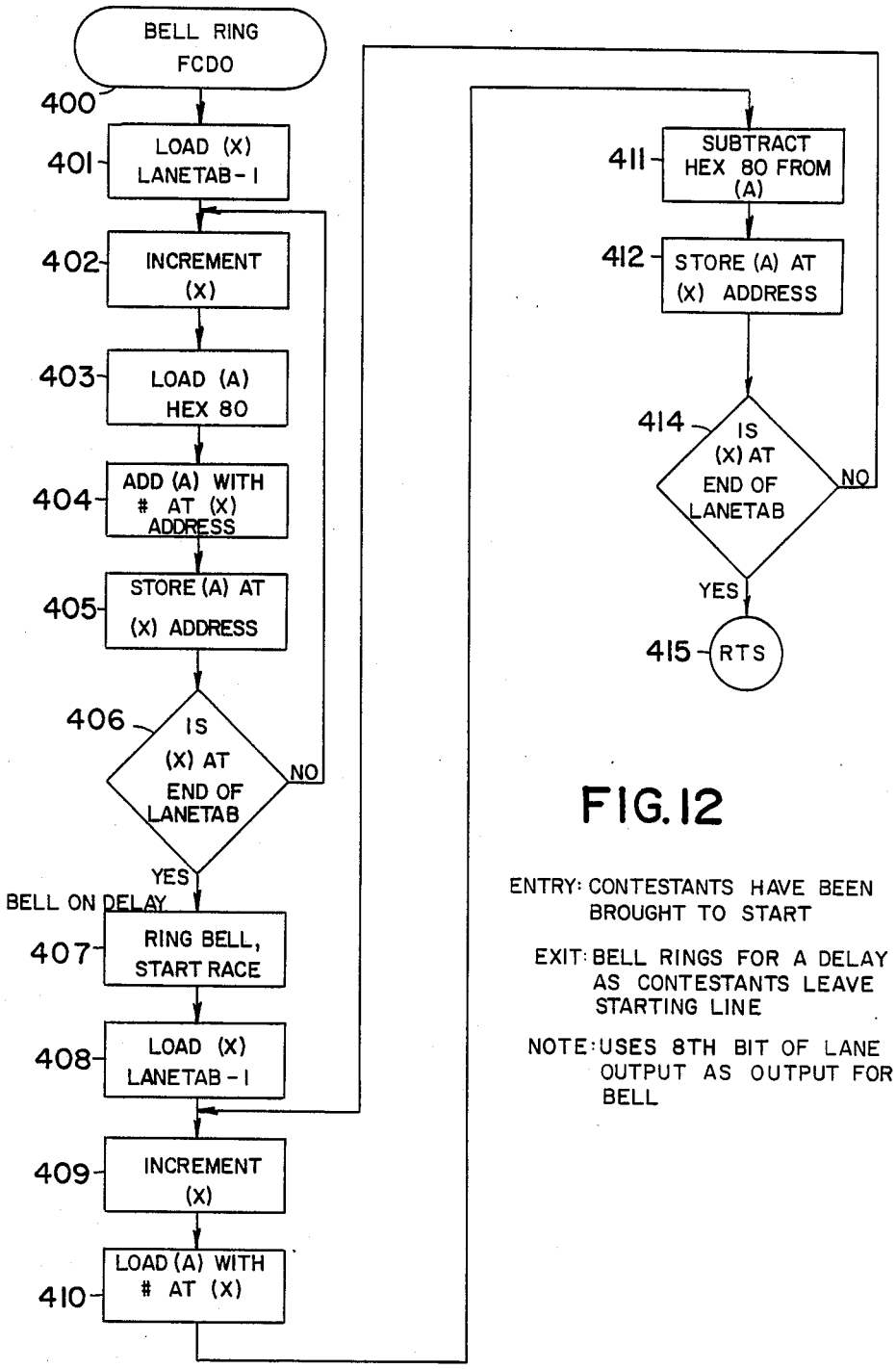
FIG. 12 shows a Bell Ring Routine in flow chart form.

Referring to FIG. 12, there is shown the Bell Ring Routine which is also shown in FIG. 10 in module 207. During the Bell Ring Routine, the entry indicates that all contestants have been brought to the start line and hence the vertical start line at position zero of FIG. 1 is illuminated. In this manner the bell will ring after a delay which is a controllable delay and the contestants start to leave the starting line as controlled by the random table of FIG. 4. The program uses the eighth bit of the lane output as output for a bell. As one can ascertain, the entire program is simply shown in flow chart form in FIG. 12.

Figure 13:
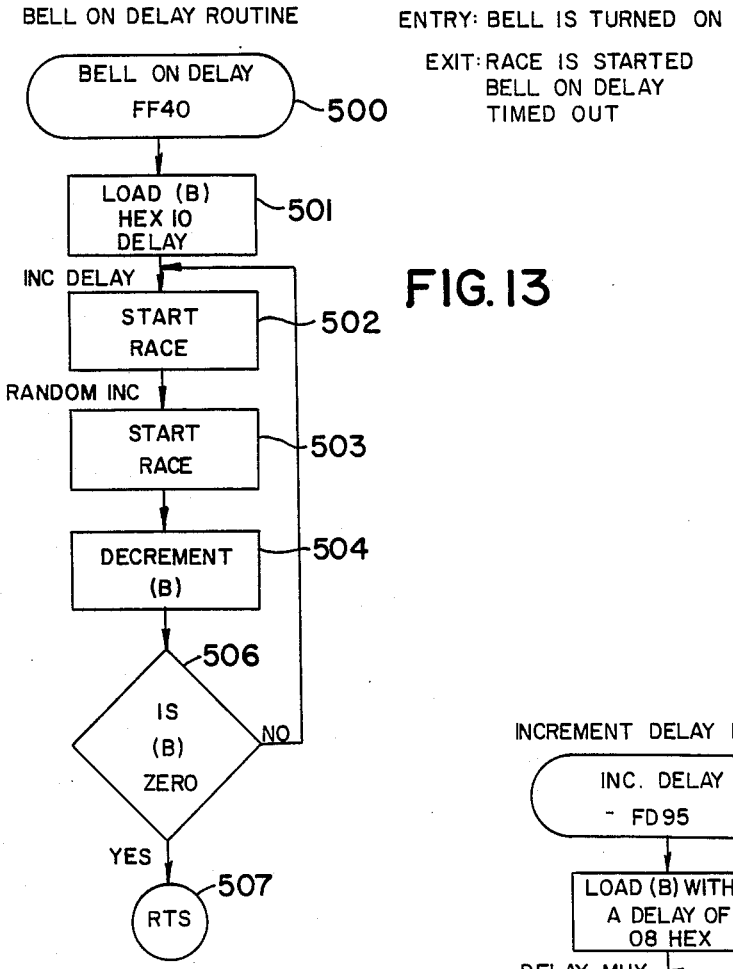
FIG. 13 shows a Bell On Delay Routine in flow chart form.

Shown in FIG. 13 is the Bell On Delay Routine. This is also shown in FIG. 12 by module 407. As indicated, once all the contestants are at the start line a bell will ring as controlled by the computer and is indicated by the program of FIG. 13. The ringing of the bell starts the race as indicated in module 502 and 503. The random list is suitably decremented and runs as indicated in FIG. 13.

Figure 14:
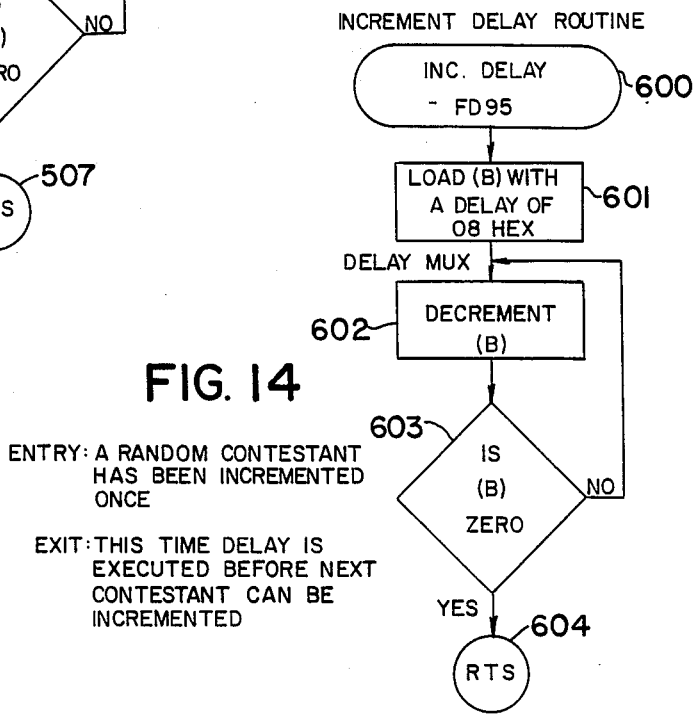
FIG. 14 shows an Increment Delay Routine in flow chart form.

Referring to FIG. 14, there is shown the Increment Delay Routine or INC Delay Routine. The entry to this routine is that a random contestant has been incremented once. The exit is that the time delay is executed before the next contestant can be incremented. This increment delay is shown in FIG. 13 and FIG. 10 and is part and parcel of the program.

Figure 15:
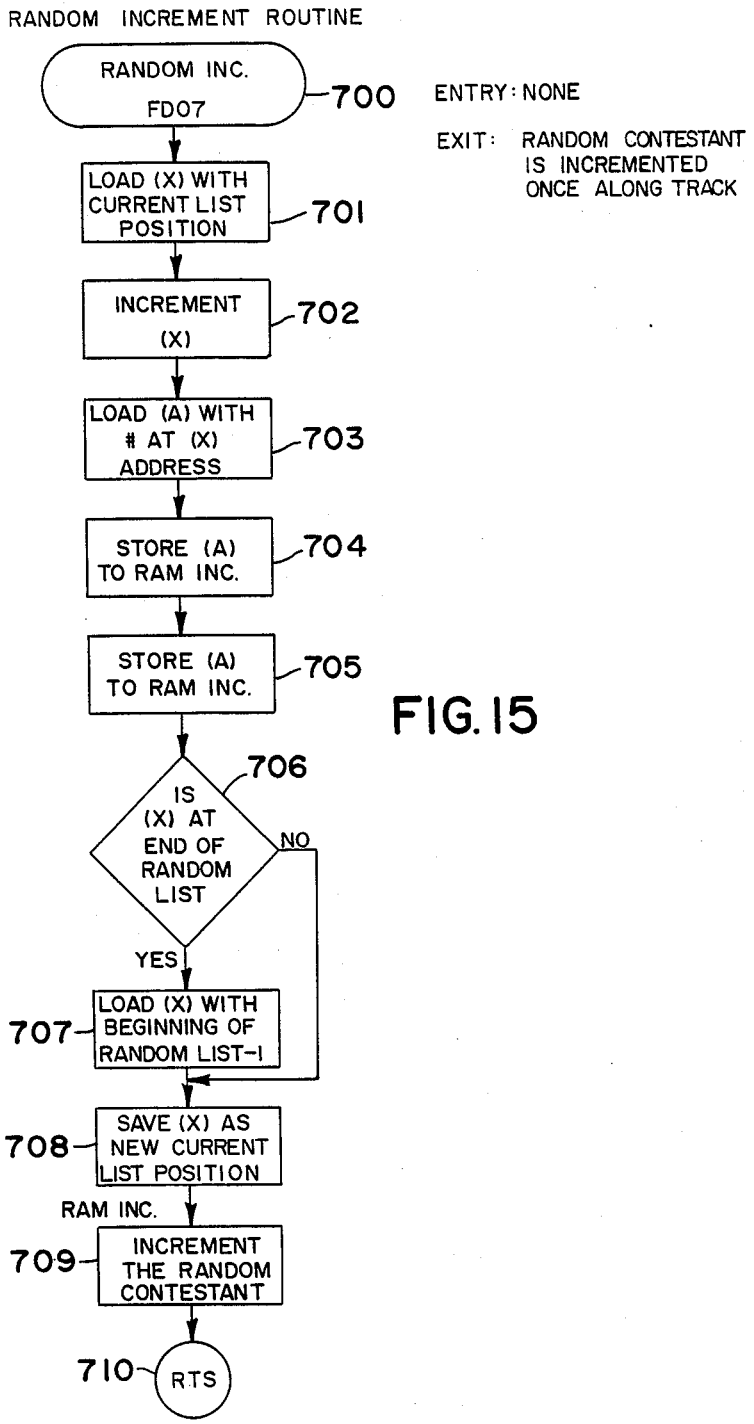
FIG. 15 shows a Random Increment Routine in flow chart form.

Referring to FIG. 15, there is shown a flow chart for the Random Increment Routine. The entry to this routine is not required. The exit is when a random contestant is incremented once along the track according to the random list as shown in FIG. 4. The FIG. 15 shows the complete programming and flow chart for implementing the random increment routine.

Figure 16:
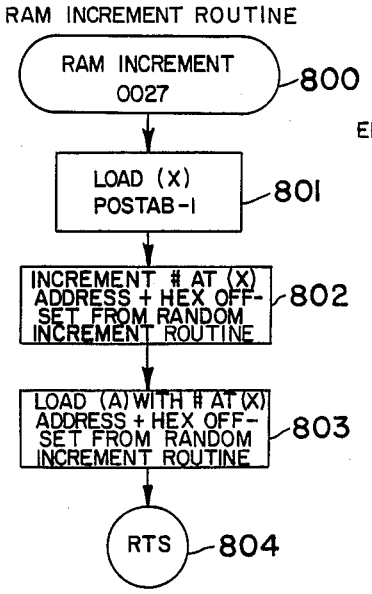
FIG. 16 shows a RAM Increment Routine in flow chart form.

FIG. 16 shows the RAM Increment Routine or RAM INC Routine. The entry to this routine is that a contestant to be incremented is set up by random increment routine and the exit is that the contest and is incremented. Also, the latest position count is put into a memory location.

Figure 17:
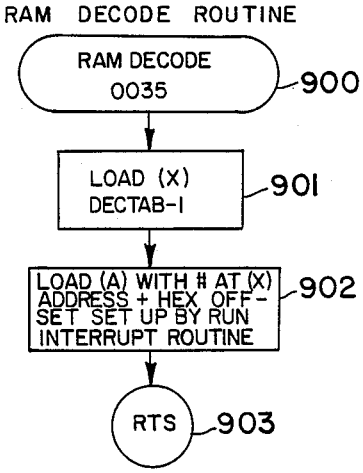
FIG. 17 shows a RAM Decode Routine in flow chart form.

FIG. 17 shows the RAM Decode Routine whereby the entry to this program is that the number to outputted is set up by the Run Interrupt Routine and the exit is that A contains the bit pattern to be outputted to the displays. As one can understand, the program listing as indicated in FIGS. 5–17 is totally complete whereby each and every aspect of the system as above described can be implemented to operate exactly as indicated. It is, of course, understood that in lieu of the implemented programs as completely under control of the microprocessor, one can utilize fixed components to structure the system. Hence, in this manner a first memory would have stored therein the table of FIG. 4 indicating the random nature of each selected lane as outputted from that table. Hence, by the use of typical registers and clock signals, one can now assure that the display lamps will be illuminated by accessing a position and lane number to activate the XY matrix. In a similar manner, the spiral pattern as shown in FIG. 1 by the darkened circles can be caused to rotate exactly as indicated by incrementing a register for each of the 32 positions around the oval 10 as shown in FIG. Thus, as, one can ascertain, many modifications can be made directly to the microprocessor programs in order to suitably control and display the above-described operation. Thus, it would be very easy to implement the above-described game so that instead of having 10 lanes representative of 10 contestants one can easily have 16 lanes. A complete race can include one traverse about the track or multiple traverses. The results of the race as displayed can be win, place or show or just win or nothing. While the game is idle, as indicated, the spiral light pattern spins about the track giving the entire game an eye catching appearance and thus persons who in the vicinity of the game display will be attracted to the same. The changes above can be simply implemented as very minimum circuit wiring is required for such options and since there is software involved only slight changes in the programs are necessary.

One can utilize a single start button to operate the display which is controlled by the operator of the display or one can utilize multiple start buttons as shown in FIG. 3 whereby each of the participants in the game can attempt to actuate the start button during the spiral pattern displays line. The above-noted random number table allows all entries an even chance to win as no entry has any particular advantage. The lamps are low voltage lamps and for example the lamps as indicated in the display are 12 volt incandescent lamps each of which are operated by a suitable driver circuit such as a transistor or other type of semiconductor device.

As shown in FIG. 3, the plexiglass screen with the art work can be changed to create a variety of races as for example car races, horse races, running races, dog races, and so on. It is of course indicated that due to the fact that the contestants are represented by incandescent lamps that the game can represent many different type of race such as a horse race and so on with just indicating the same on the plexiglass cover member. The game can include, apart from the above-described bell sound, various other sounds which can be implemented during operation of the race and under strict control of the microprocessor. Such techniques for implementing such operation are well known in the art.

I claim:

1. An electronic game apparatus comprising:

a plurality of visual display indicators arranged in an oval pattern indicative of a race track display, with said pattern formed by said display indicators having a plurality of concentric ovals each indicative of a racing position, with each concentric oval having the same number of display indicators about said oval as said other ovals with each indicator in an oval indicative of a position about said oval, with each of said indicators arranged in an X-Y pattern to be accessed by a separate X-Y address, where X is the one address of said oval and Y is the address of said position indicators, microprocessor means coupled to said X-Y matrix for randomly selecting said X-Y addresses according to a stored table in memory to cause said indicators to illuminate in a random pattern about said oval during a racing mode, activatable means coupled to said microprocessor means for selecting said racing mode to cause said microprocessor means to implement said random selection during said racing mode, said microprocessor including means for storing the results of each race indicative of one of said racing positions completing said race track display as randomly implemented to display said completed position indicative of a winner and means for illuminating said display with a repetitive offset pattern during a non-racing mode to cause said indicators to provide a display pattern which has visual appeal.

2. The apparatus according to claim 1, wherein said concentric ovals are at least 10 in number, with 32 positions indicators located in each oval.

3. The apparatus according to claim 1, wherein said repetitive offset pattern is a spiral pattern.

4. The apparatus according to claim 2, wherein said stored table is a random number table having at least forty entries for each concentric oval and thus having 400 entries for 10 concentric ovals.

5. The apparatus according to claim 1, further including means associated with said microprocessor to cause said stored table to randomly circulate during said non-racing mode whereby when said means coupled to said microprocessor for selecting said racing mode are activated said stored table is randomly accessed due to said random circulation.

6. The apparatus according to claim 1, wherein said means coupled to said microprocessor for selecting said racing mode includes a start switch coupled to said microprocessor for implementing an interrupt to enable said microprocessor to operate in said racing mode.

7. The apparatus according to claim 6, further including means associated with said microprocessor for stopping said repetitive offset pattern when said start switch is activated and including means for illuminating one adjacent indicator in each concentric oval indicative of a start position and delay means associated with said microprocessor to start said racing mode after said adjacent indicators are aligned at said start position.

8. The apparatus according to claim 1, wherein repetitive offset pattern is manifested by means for illuminating one different position indicator in each concentric oval according to a desired patter display.

9. The apparatus according to claim 1, wherein said display indicators are a plurality of incandescent lamps.

10. A method of controlling an oval display indicative of a race track display having a plurality of concentric ovals with each oval indicative of a different post position and with each oval having the same given number of visual indicators indicative of a given position about said race track display, comprising the steps of:

illuminating said indicators to display a repetitive offset pattern indicative of a non-racing mode, stopping said repetitive offset pattern during the selection of a racing mode, illuminating one adjacent indicator in each oval to provide an illuminated vertical line indicative of a start of race, randomly advancing said indicators by selectively illuminating indicators in each oval according to a random pattern, determining which post position finishes first by viewing said pattern with respect to a finish line indicative of the end of said race, and illuminating said indicators to display said repetitive pattern at said end of said race, while storing and displaying said first finishing post position.

11. The method according to claim 10, further including the step of selecting a racing mode or a non-racing mode.

12. The method according to claim 10, further including the step of delaying the start of said race for a given duration after said vertical start line is displayed.

13. The method according to claim 12, further including the step of sounding a start of race alarm after said given duration delay.

14. The method according to claim 10, further including the step of accessing a random number table during said step of randomly advancing to advance said indicators according to the contents of said table.

15. The method according to claim 14, further including the step of circulating the number stored in said table during said non-racing mode to cause said table to be randomly accessed during the start of a race.

16. The method according to claim 10, further including the step of determining the post position finishing, second and third and displaying said post positions at the end of said race.

17. The method according to claim 10, including the step of arranging said indicators in an X-Y matrix wherein each oval has an X address with each position in said oval having a Y address.

18. The method according to claim 10, wherein said steps are implemented by programming a microprocessor.

19. The method according to claim 10, wherein said display has 10 concentric ovals with each oval having 32 position indicators.

20. The method according to claim 10, wherein the steps of illuminating include illuminating incandescent lamps.

* * * * *